US007395640B1

(12) United States Patent
Wang

(10) Patent No.: US 7,395,640 B1
(45) Date of Patent: Jul. 8, 2008

(54) ELECTRIC DISPENSER FOR WRAP FILM

(76) Inventor: Ching-Hsiang Wang, P.O. Box 90, Tainan City 70499 (TW)

( * ) Notice: Subject to any disclaimer, the term of this patent is extended or adjusted under 35 U.S.C. 154(b) by 7 days.

(21) Appl. No.: 11/687,654

(22) Filed: Mar. 18, 2007

(51) Int. Cl.
*B65B 41/12* (2006.01)
*B26D 5/08* (2006.01)

(52) U.S. Cl. ..... 53/389.3; 83/614; 83/649

(58) Field of Classification Search ..... 53/389.3; 83/614, 649, 650
See application file for complete search history.

(56) References Cited

U.S. PATENT DOCUMENTS 3,748,939 A * 7/1973 Feinstein et al. ..... 53/390
4,186,633 A * 2/1980 Baumann et al. ..... 83/649
4,817,483 A * 4/1989 Armbruster ..... 83/614
4,834,309 A * 5/1989 Raymond ..... 225/11
4,848,201 A * 7/1989 Urwyler et al. ..... 83/649
5,107,734 A * 4/1992 Armbruster ..... 83/614
5,131,302 A * 7/1992 Watanabe ..... 83/649
6,651,537 B1 * 11/2003 Pfeiffer ..... 83/614
6,820,785 B2 * 11/2004 Kapiloff ..... 225/14
6,938,397 B2 * 9/2005 Miller ..... 53/389.3
6,994,408 B1 * 2/2006 Bunnell ..... 83/211

* cited by examiner

*Primary Examiner*—Stephen F. Gerrity

(57) ABSTRACT

An electric dispenser for wrap film includes a base, two side covers, a conveying track, a driving device, a cutting device, an accommodating case and a bottom cover. The conveying track is contained in the base, driven by the driving device to pull out the wrap film. The cutting device includes a driving motor, a threaded bar, a blade fixing base and an auxiliary rod. The driving motor is commanded by the driving device to drive the threaded bar to rotate to enable the blade fixing base to move along the threaded bar. The blade-fixing base has a blade extended to the surface of the conveying track to cut off the wrap film. The accommodating case is set on the top of the base, for positioning the wrap film in it. The wrap film is replaceable.

12 Claims, 10 Drawing Sheets

ELECTRIC DISPENSER FOR WRAP FILM

BACKGROUND OF THE INVENTION

1. Field of the Invention

This invention relates to an electric dispenser for wrap film, particularly to one composed of a base, two side covers, a conveying track, a driving device, a cutting device, an accommodating case and a bottom cover, able to cut off the wrap film safely, used conveniently and replaceable with a new wrap film quickly.

2. Description of the Prior Art

Nowadays, wrap film is often used to wrap around foods or on containers, such as a bowl and a dish etc, with foods so as to keep foods free from dirt or contaminated by fly or insects, or dehydrated if stored in a refrigerator, especially for vegetables and fruits. Or, if foods are to be cooked by microwave or steam, they can be wrapped with wrap film to keep airtight or warm. Therefore, wrap film is really necessary for cooking or foods storing.

As shown in FIG. 1, a conventional wrap film dispenser is provided with a wrap film spool 10 stored in a rectangular box 11 having one of its sides set as a door 12 able to be opened to form an opening on the box 11. Along the edge of the opening is installed a toothed cutter 13. In using, wrap film 100 is first pulled out to an expected length by one hand and next, the other hand has to press on the door 12, so that the hand holding the end of the wrap film 100 can force oppositely against the cutter 13 to keep the wrap film 100 cut off. But, actually, although the door 12 is pressed by a user, the wrap film 100 is always unapt to be torn off, keeping it entangled to become wasted or cut deformed, because of an uneven force pressed along the cutter 13. In addition, the cutter 13 is installed outside the box 11, possible to hurt a user's hand while tearing the wrap film 100 incautiously.

Therefore, the invention has been devised to overcome the defects mentioned above.

SUMMARY OF THE INVENTION

The objective of this invention is to offer a power dispenser for wrap film, able to cut off the wrap film safely, be used conveniently and be replaced with a new wrap film quickly.

The main characteristics of the invention are a base, two side covers, a conveying track, a driving device, a cutting device and an accommodating case. The base is provided with a chamber formed inside it, sidewalls formed around it, and locking grooves formed in the sidewalls. One of the sidewalls is bored with a shaft hole. Each of the side covers is installed at two sides of the base respectively. One of the side covers is bored with a shaft hole. The conveying track is installed in the chamber of the base, provided with at least two axial tubes, positioning caps inserted in two ends of each of the axial tubes for locking in the locking grooves of the base, and a driving cap fitted in one end of one of the axial tubes and having female gear teeth set at its one end. The driving device is installed outside one of the side covers, provided with a synchronous motor having a driving gear set at its one side for engaging with the female gear teeth of the driving cap of the conveying track. The synchronous motor is fixed in a control box that is installed with a switch and a button. The cutting device is stretched across the side covers, provided with a driving motor, a threaded bar, a blade fixing base and an auxiliary rod. The driving motor is driven by the driving device to activate the auxiliary rod to rotate. The blade-fixing base is attached on the auxiliary rod to move axially along it, provided with a blade fitted at its one side to extend to a surface of the conveying track. The accommodating case is installed on the top of the base, provided with two sidewalls respectively having a locking groove, an auxiliary roller installed at its bottom, a conical pole and a positioning cap inserted in two ends of a spool of the wrap film to keep the wrap film positioned in the accommodating case. The conical pole is fitted with a ring to tightly attach around an interior wall of the spool.

BRIEF DESCRIPTION OF DRAWINGS

This invention is better understood by referring to the accompanying drawings, wherein.

DETAILED DESCRIPTION OF THE PREFERRED EMBODIMENT

Figure 1:
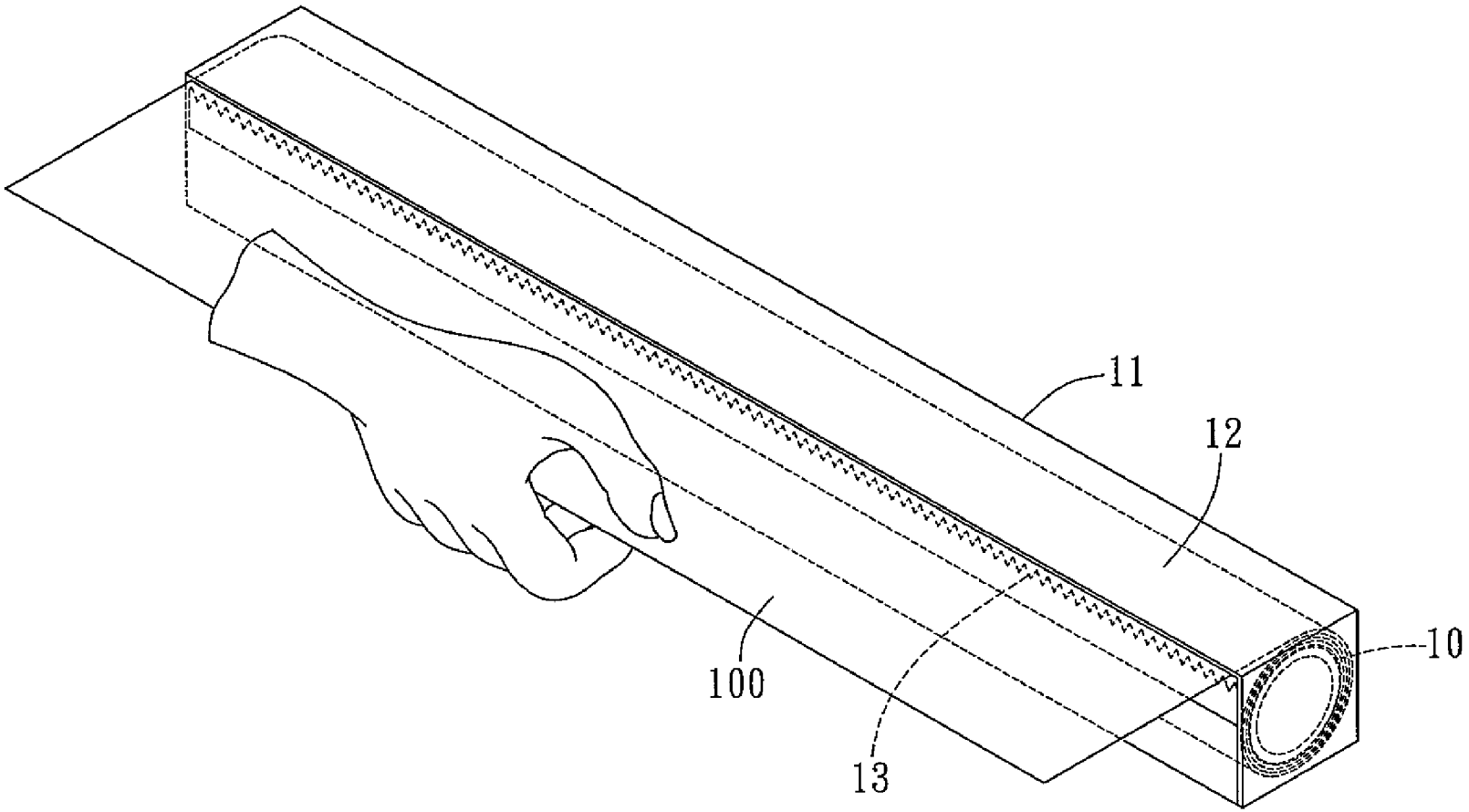
FIG.1 (PRIOR ART)
FIG. 1 is a perspective view of a conventional wrap film, showing it being used.

As shown in FIGS. 2~7, a preferred embodiment of an electric dispenser for wrap film in the present invention includes a rectangular base 2, two sidewalls 3, a conveying track 4, a driving device 5, a cutting device 6, an accommodating base 7 and bottom cover 9 as main components.

The base 2 is provided with a chamber 20 formed inside it and a sidewall 21 respectively formed at its right, left and bottom side. Each of the sidewalls 21 is bored with plural screw holes 210, and there is a pinhole 22, an elastic pinhole 23 and a blocking pinhole 24 bored on each of the right and the left sidewall 21. In addition, three locking grooves 25 shaped similar to C are formed along the edge of the right and the left sidewall 21, and a shaft hole 26 is bored on the left sidewall 21. The chamber 20 is additionally provided with a blocking strip 200 projected at a proper location of its back, and two hooking holes 201 bored near the top of its back.

Each of the side covers 3 is installed on two sides of the base 2, provided with plural screw holes 30 bored on its outside wall near the top, and plural threaded columns 31 located inside to correspond to the screw holes 210 of the sidewalls 21 of the base 2 respectively. The threaded column 31 has one of its ends formed recessed in the outside surface of the side cover 3. Each of the side covers 3 is also provided with a pin 32 projected near its top to correspond to the pin hole 22 of the base 2, a locking block 33 also projected near its top to correspond to the pin hole 23 of the base 21, and a blocking pin 34 extended inward to correspond to the blocking pin hole 24 of the base 2. The locking block 33 is provided with a locking slot 330 dug on its front end. The right side cover 3 is provided with two accommodating grooves 35 and the left side cover 3 is provided with a recessed accommodating groove 35 to correspond with the locking grooves 25 of the base 2. The left side cover 3 is provided with a shaft hole 36 bored corresponding to the shaft hole 26 of the base 2, and plural threaded columns 37 projected on its outside surface. Each of the side covers 3 is additionally provided with a blade aperture 38 opened in an upper portion for fitting with a blade 621 of the cuffing device 6, and a concaved surface 39 located on its top.

The conveying track 4 installed in the chamber 20 of the base 2 is provided with toothed conveying bands 40 laid fully on its surface, an axial tube 41 fitted at its two ends respectively, two positioning caps 42 installed in two ends of the lower axial tube 41. Each of the positioning caps 42 is provided with a blocking flange 420 used to keep the axial tube 41 restricted, and an elastic hook 421 set outside the blocking flange 421 for locking with the locking groove 25 of the base 2, enabling the axial tube 41 to rotate at the position. The conveying track 4 is also provided with a driving cap 43 fitted in the left end of the upper axial tube 41. The driving cap 43 is to be correspondingly fitted in the shaft holes 26 and 36 of the base 2 and the side cover 3, provided with a blocking flange 430 to restrict the axial tube 41, and female gear teeth 431 set at its outside end.

Figure 2:
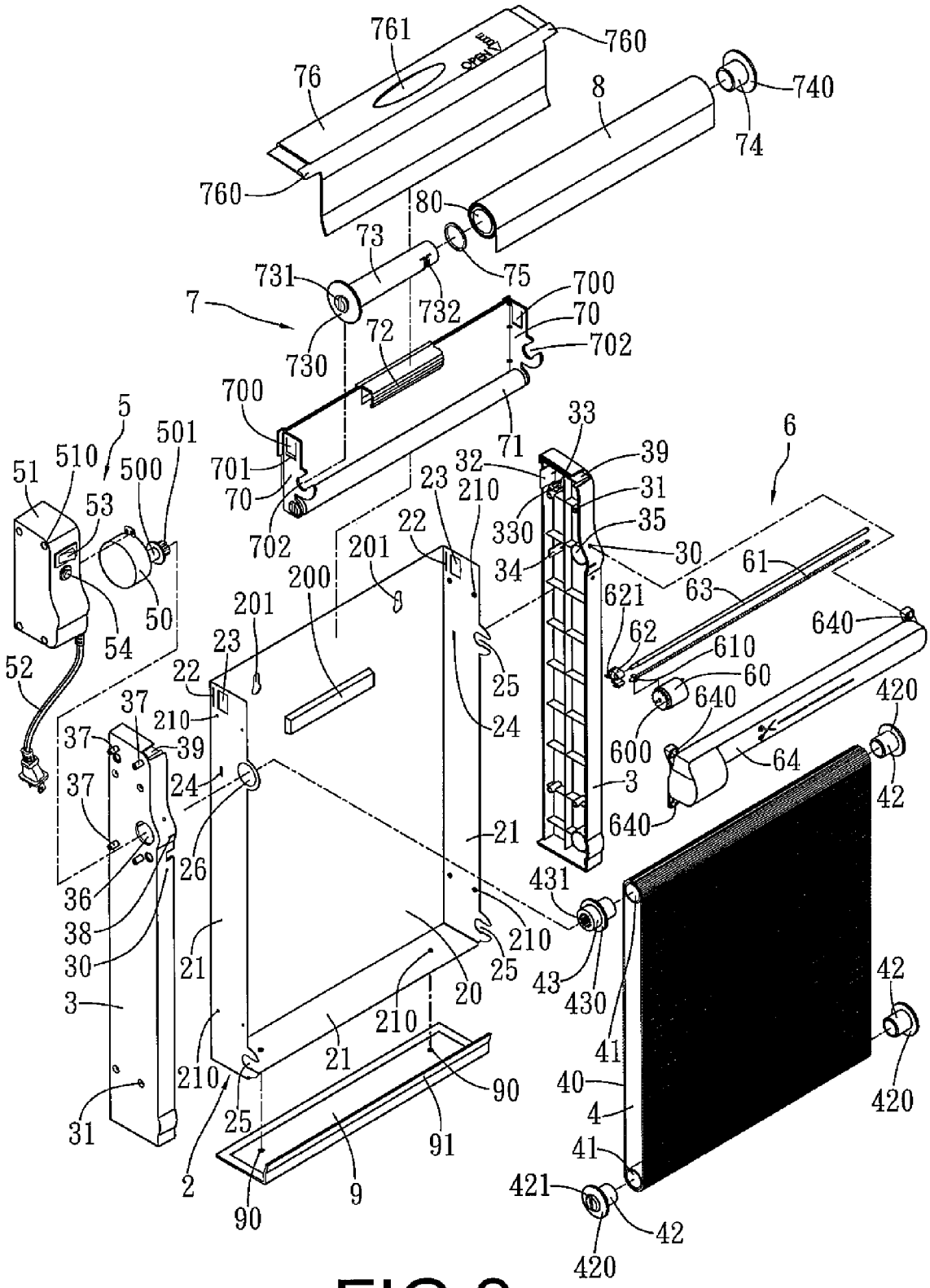
FIG. 2 is an exploded perspective view of a preferred embodiment of an electric dispenser for wrap film in the present invention.
Figure 4:
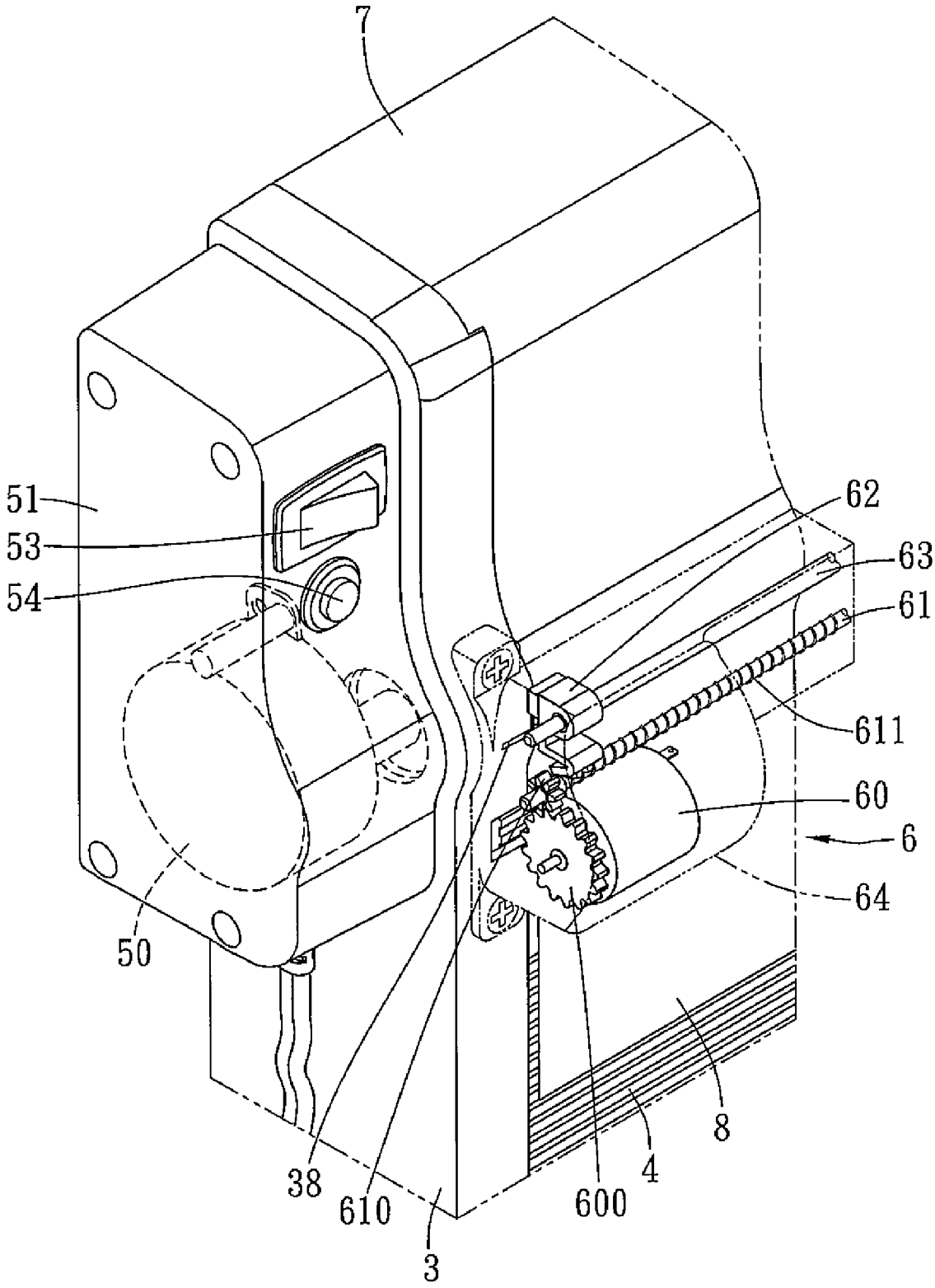
FIG. 4 is a perspective view of the preferred embodiment of an electric dispenser for wrap film in the present invention, showing a driving device and the cutting device.
Figure 5:
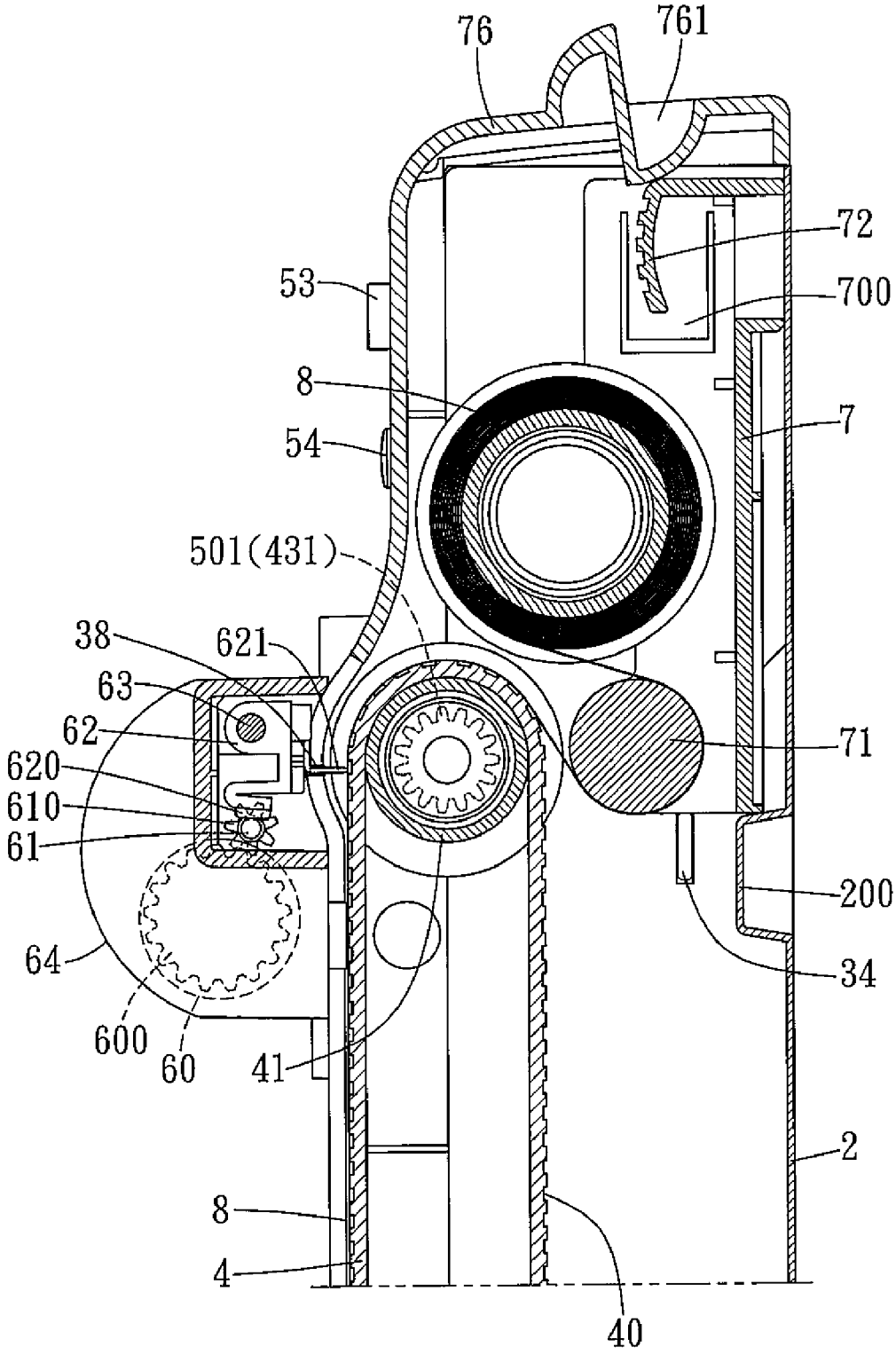
FIG. 5 is a side cross-sectional view of the preferred embodiment of an electric dispenser for wrap film in the present invention.

The driving device 5 is installed outside the left side cover 3, as shown in FIGS. 2, 4 and 5, provided with a synchronous motor 50 fixed in a control box 51, and a power line 52 linked to the control box 51 to supply power for the synchronous motor 50. The synchronous motor 50 is provided with a shaft 500 extended outward from one side, and a driving gear 501 set at one end of the shaft 500 for engaging with the female gear 431 of the driving cap 43 of the conveying track 4 to drive the conveying track 4 to work via passing through the shaft holes 26 and 36 of the base 2 and the side cover 3. The control box 51 is provided with plural screw holes 510 for fitting with the threaded columns 37 of the left side cover 3. The driving device 5 is additionally provided with a switch 53 and a button 54 set on the control box 51, for respectively turning on/off the synchronous motor 50 and the cutting device.

Figure 3:
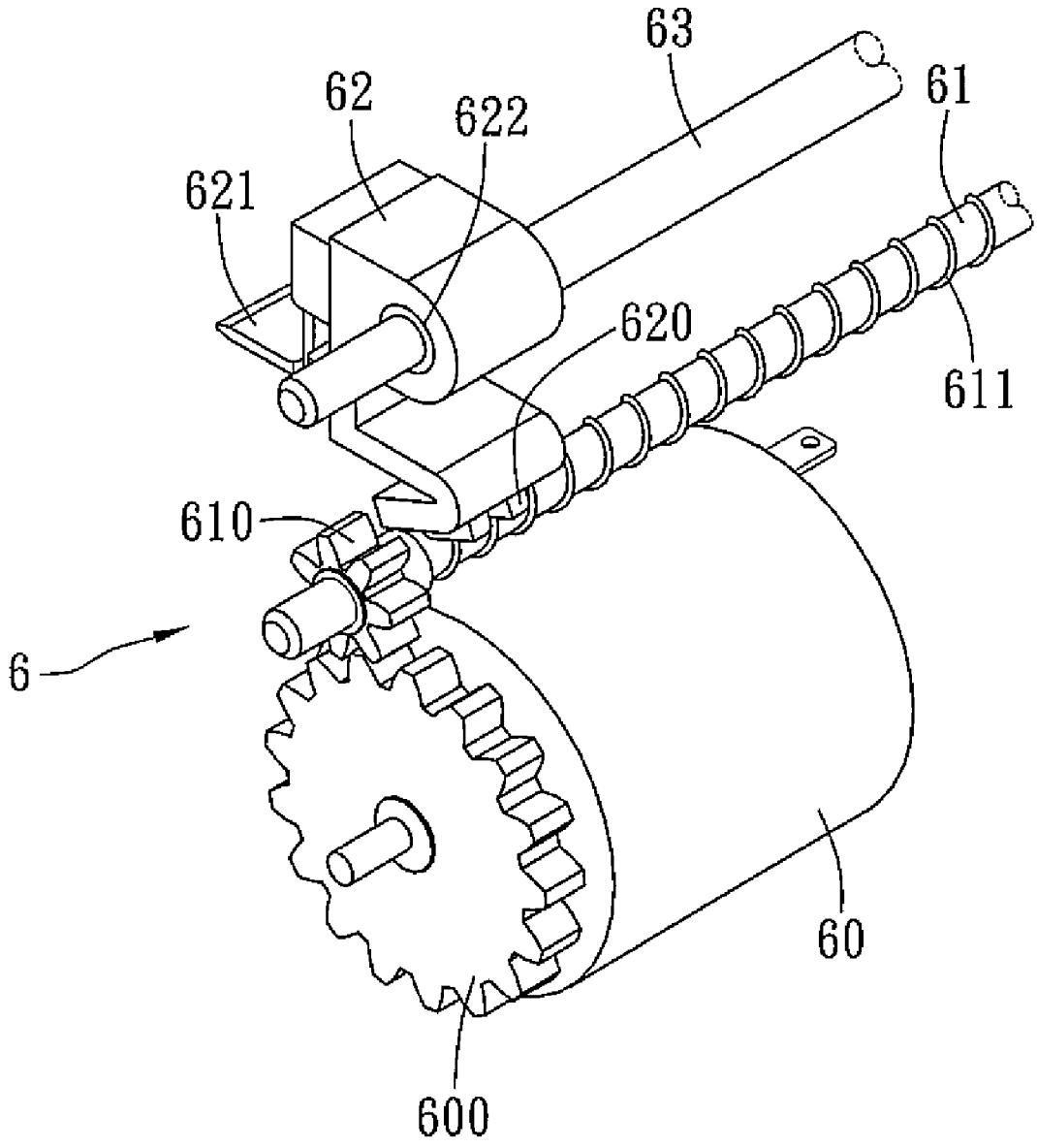
FIG. 3 is a perspective view of a cutting device of the preferred embodiment of an electric dispenser for wrap film in the present invention.
Figure 8:
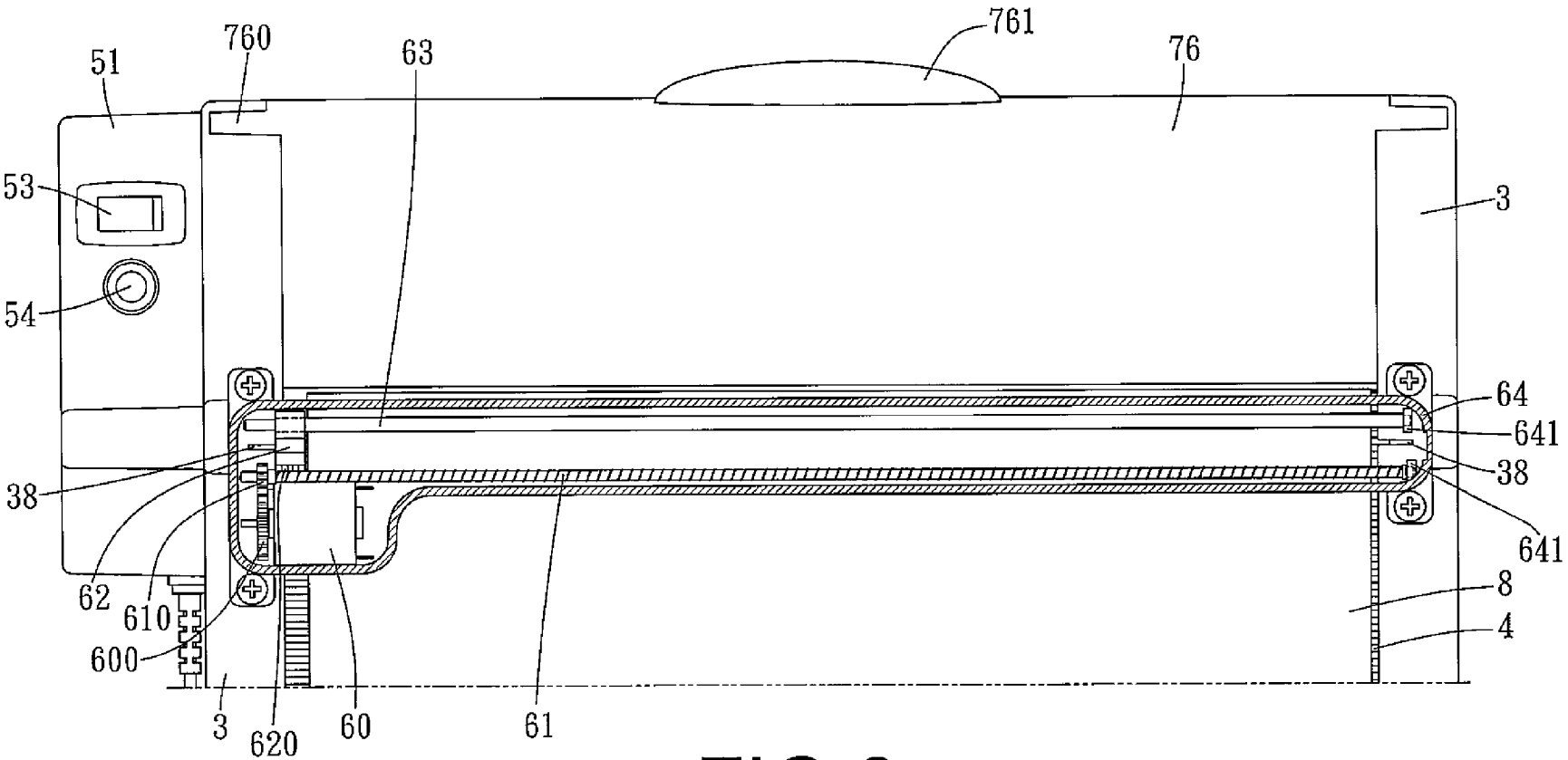
FIG. 8 is a first cross-sectional view of the cutting device of the preferred embodiment of an electric dispenser for wrap film in the present invention, showing it being used.

The cutting device 6 stretched across the side covers 3 as shown in FIGS. 2~4 is provided with a driving motor 60 connected to and controlled by the button 54 of the driving device 5 via a power line, and a threaded bar 61. The driving motor 60 is provided with a driving gear 600 located at its outside for engaging with a small gear 610 provided at one end of the threaded bar 61. The cutting device 6 is also provided with a blade fixing base 62 fitted on the top of the threaded bar 61 via plural guiding strips 620 located at one side of the blade fixing base 62, so as to enable the blade fixing base 62 to reciprocate horizontally along the threads 611 of the threaded bar 61. The blade fixing base 62 is also provided with a blade 621 positioned at its other side, extending toward the chamber 20 of the base 2 to keep its edge positioned exactly on the surface of the conveying track 4 and fitted in the blade aperture 38 of the side covers 3, and a through hole 622 located above the outside of the blade 621. In addition, the cutting device 6 is provided with an auxiliary rod 63 inserted through the through hole 622 of the blade fixing base 62, and a cover 64 used to shelter the driving motor 60, the threaded bar 61, the blade fixing base 62 and the auxiliary rod 63, provided with screw holes 640 at its two sides corresponding to the screw holes 30 of the side covers 3, and two posts 641 installed at one side of its interior wall for supporting the ends of the threaded bar 61 and the auxiliary post 63, as shown in FIG. 8.

Figure 6:
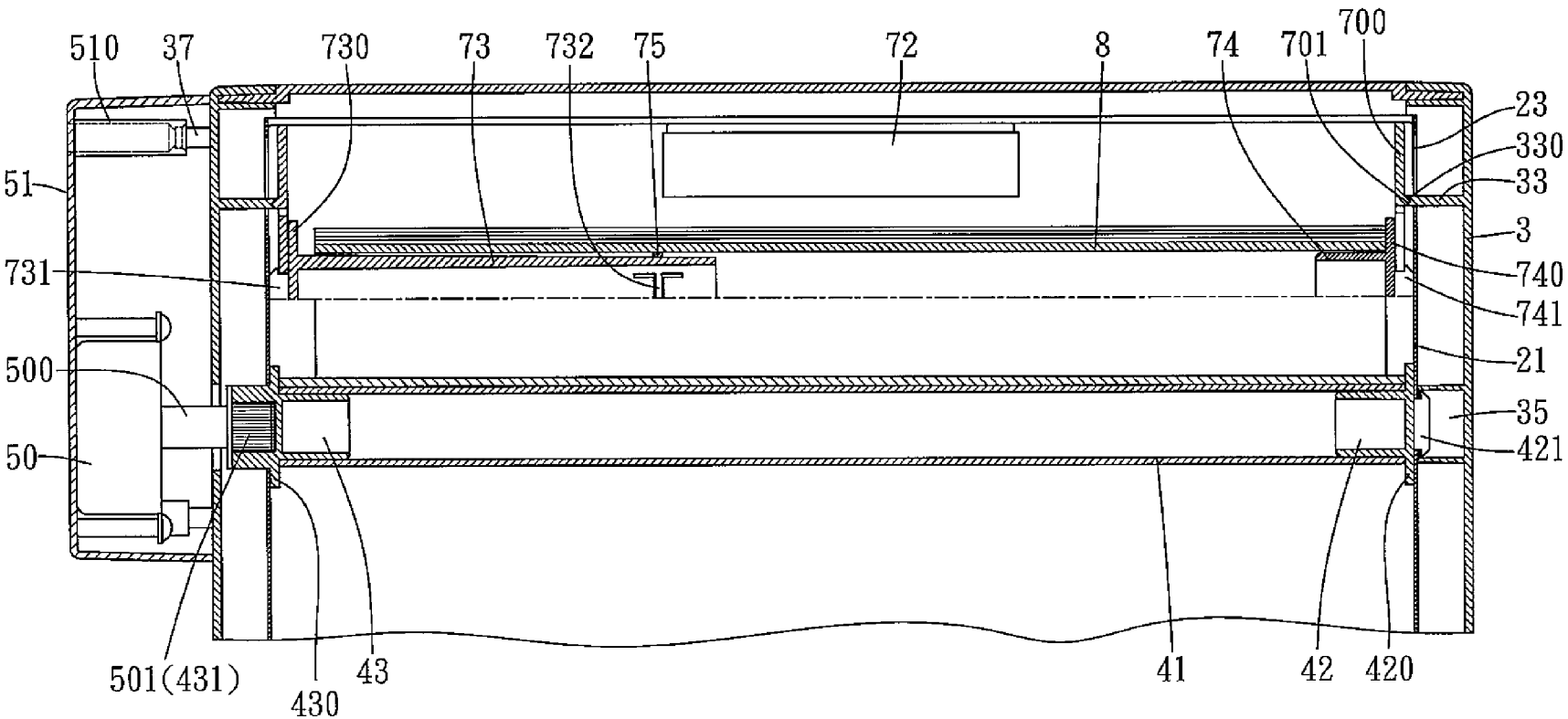
FIG. 6 is a first partial cross-sectional view of an accommodating case and a conveying track of the preferred embodiment of an electric dispenser for wrap film in the present invention.
Figure 7:
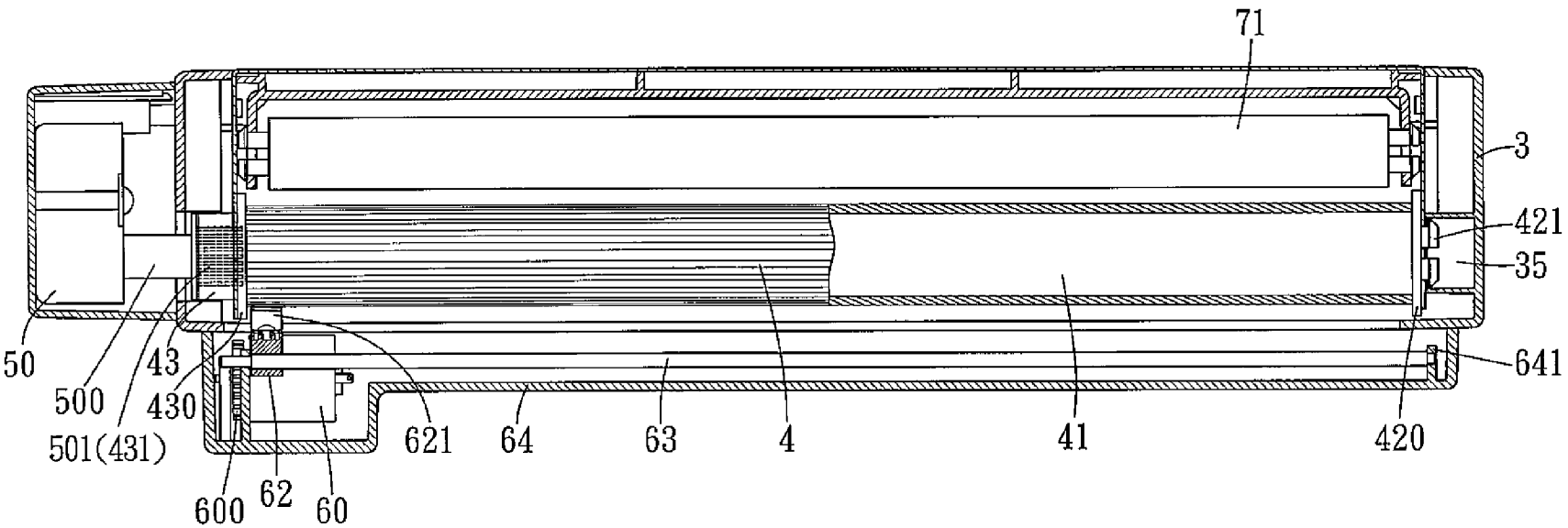
FIG. 7 is a second partial cross-sectional view of the accommodating case and the conveying track of the preferred embodiment of an electric dispenser for wrap film in the present invention.

The accommodating case 7 installed on the top of the base 2 as shown in FIGS. 2, 5 and 6 is provided with two sidewalls 70, an auxiliary roller 71 installed at its bottom, a grip 72 set on its top, a conical pole 73 and a positioning cap 74 used to keep the wrap film 8 positioned in the accommodating case 7. Each of the sidewalls 70 is provided with a blocking elastic pin 700 located on its top portion, a blocking edge 701 formed at the outside of the end of the blocking elastic pin 700 for locking with the locking slot 330 of the locking block 33 of the side cover 3 to keep positioned via passing through the elastic pin hole 23 of the sidewall 21 of the base 2, and a locking groove 702. Each of the conical pole 73 and the positioning cap 74 is provided with a blocking flange 730 and 740 formed at its outside to lean against two ends of a spool 80 of the wrap film 8, an elastic hook 731 and 741 set outside the blocking flange 730 and 740 for locking with the locking groove 702 of the sidewall 70 to enable the conical pole 73 and the wrap film 8 to rotate at the position. The conical pole 73 is in addition provided with an annular locking groove 732 for locking with a ring 75 that is to attach around the interior wall of the spool 80 of the wrap film 8. In addition, a cover 76 is set on the top of the accommodating case 7, provided with a projection 760 extended out at the top of its two sides respectively for locking with the concaved surface 39 of the side covers 3, and an opening 761 for a hand to easily open the cover 76.

The bottom cover 9 installed at the bottom of the base 2 is provided with plural screw holes 90 corresponding to the screw holes 210 of the lower sidewall 21 of the base 2, and a front cover 91 formed via bending its front portion, able to just lock on the bottom of the side covers 3 to make the whole invention look aesthetic.

Figure 10:
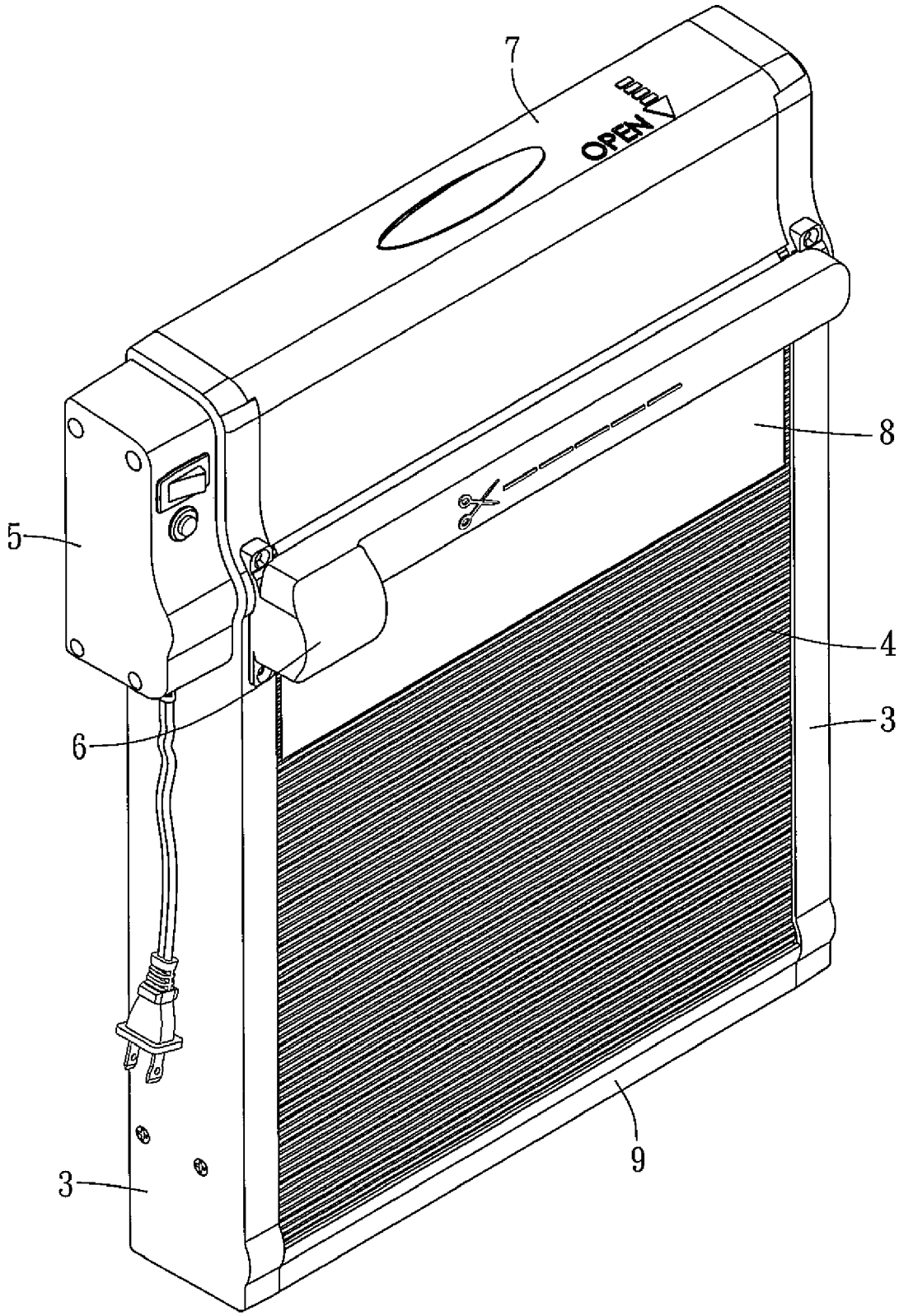
FIG. 10 is a perspective view of the preferred embodiment of an electric dispenser for wrap film in the present invention.

In assembly, as shown in FIGS. 2, 4~6, and 10, the positioning caps 42 and the driving cap 43 are first inserted in the ends of the axial tubes 41 of the conveying track 4. The conveying track 4 is next installed in the chamber 20 of the base 2, keeping the elastic hooks 421 of the positioning caps 42 locked in the locking grooves 25 of the sidewalls 21 of the base 2, enabling the axial tubes 41 to rotate at the position, and the female gear 431 of the driving cap 43 fitted exactly in the shaft hole 26 of the sidewall 21. The side covers 3 are next assembled on two sides of the base 2, enabling the pins 32 of the side covers 3 fitted in the pin holes 22 of the sidewalls 21 of the base 2, the locking blocks 33 fitted in the elastic pin holes 23, the blocking pins 34 fitted in the blocking pin holes 24, and the screw holes 31 of the side covers 3 corresponding to and screwed with the screw holes 210 of the sidewalls 21 of the base 2. By the time, the elastic hooks 420 of the positioning caps 42 of the conveying track 4 extending out of the sidewalls 21 are just confined in the accommodating groove 35 of the side cover 3. Next, the driving device 5 is installed outside of the left side cover 3, keeping the driving gear 501 engaged with the female gear 431 of the driving cap 43 via passing through the shaft holes 36 and 26 of the side cover 3 and the sidewall 21 of the base 2. The cuffing device 6 is stretched across the side covers 3, enabling the blade 621 of the blade fixing base 62 to stay in the blade apertures 38 of the side covers 3, and the screw holes 640 of the cover 64 to correspond to and screwed with the screw holes 30 of the side covers 3. Then, the bottom cover 9 is installed at the bottom of the base 2, keeping the front cover 91 covered on the bottom of the base 2 and locked with the bottom of the side covers 3, and the screw holes 90 corresponding to and screwed with the screw holes 210 of the bottom sidewall 21 of the base 2. The accommodating case 7 is installed at the top of the base 2 for containing the wrap film 8, first keeping the through pole 73 inserted in one end of the spool 80 of the wrap film 8 after mounted with the ring 75 and the positioning cap 74 inserted in the other end of the spool 80, and then keeping the elastic hooks 731 and 741 locked in the locking grooves 702 of the sidewalls 70 to enable the spool 80 of the wrap film 8 to rotate immovably. Next, the wrap film 8 is pulled out with a certain length to wind around and from the rear of the auxiliary roller 71 to attach on the conveying track 4, as shown in FIG. 5. The accommodating case 7 is then pushed into the chamber 20 of base 2, keeping the blocking elastic pins 700 passing through the elastic pin holes 23 of the sidewalls 21 of the base 2 so that the blocking edges 701 can lock fixedly with the locking slots 330 of the locking blocks 33 of the side covers 3. By the time, the accommodating case 7 is loaded on and supported by the blocking strip 200 of the chamber 20 of the base 2 with its bottom, and supported by the blocking pins 34 of the side covers 3 extending through the blocking pin holes 24 of the base 2 with two ends of its bottom. Finally, the cover 76 is closed on the top of the accommodating case 7 by means of the projections 760 locking with the concaved surfaces 39 of the side covers 3, as shown in FIG. 10.

Figure 9:
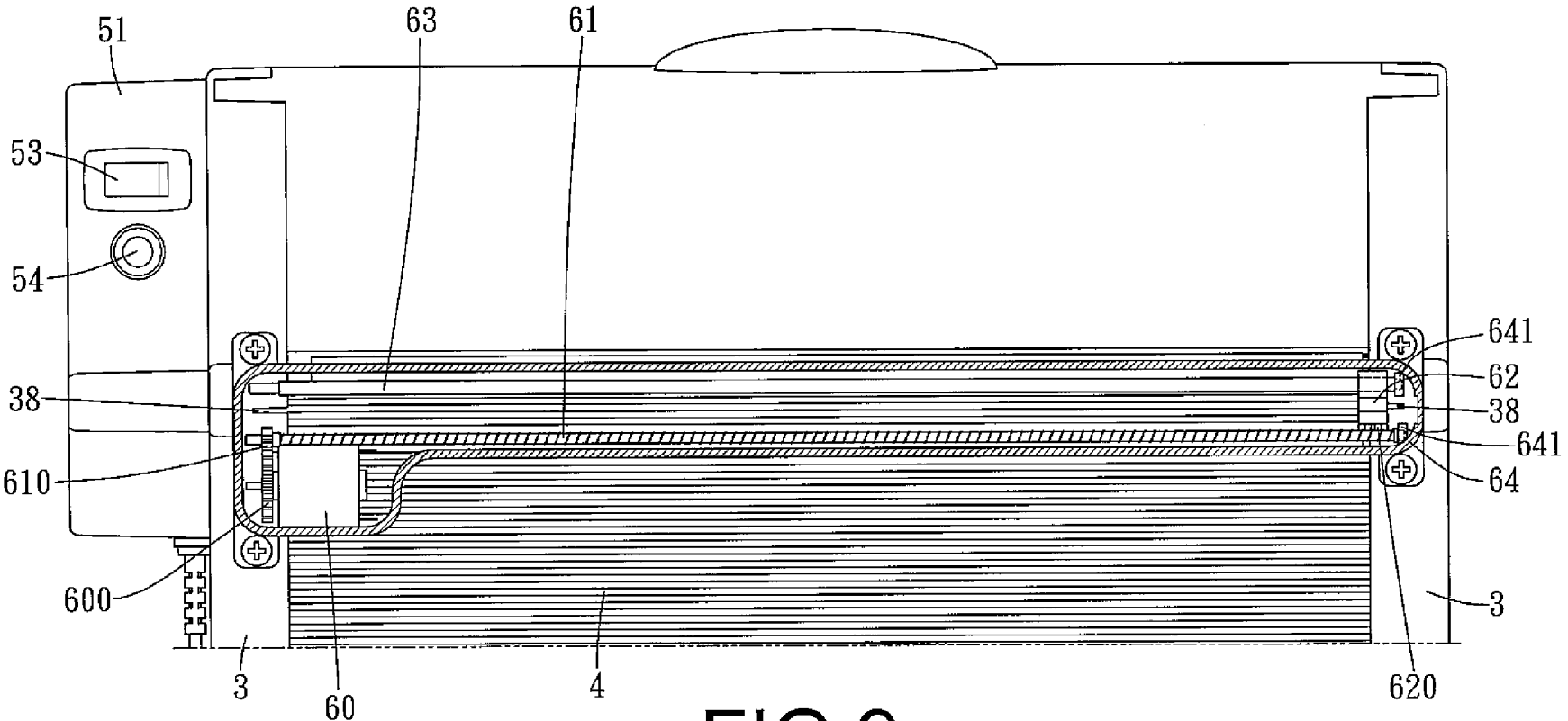
FIG. 9 is a second cross-sectional view of the cutting device of the preferred embodiment of an electric dispenser for wrap film in the present invention, showing it being used.

In using, as shown in FIGS. 4~9, the power line 52 of the driving device 5 is first connected to a power source and the switch 53 on the control box 51 is pressed down to activate the synchronous motor 50 to enable the shaft 500 and the driving gear 501 to start rotating. The driving cap 43 of the conveying track 4 is simultaneously driven by the driving gear 501 to keep the conveying track 4 moved, prompting the wrap film 8 attaching on the conveying track 4 to be pulled out. The synchronous motor 50 has to be paused while the wrap film 8 is extended out with a certain length. Afterwards, the button 54 of the control box 51 is pressed to activate the driving motor 60 that is to meanwhile enable the driving gear 600 and the small gear 610 engaged with the driving gear 600 to rotate. By the time, the blade fixing base 62 is to be driven by the threaded bar 61 to move horizontally along the threads 611, as shown in FIG. 9, enabling the blade 621 to cut off the wrap film 8 conveyed by the conveying track 4. Therefore, the invention can cut off the wrap film electrically and safely. In addition, the invention can be slung on a wall via the hooking holes 201 of the chamber 20 of the base 2.

If the wrap film 8 is to be replaced with a new one, just open the cover 76 and hold the grip 72 to pull out the accommodating case 7 with a little force, so as to take out the spool 80 and re-fill a new wrap film 8. Then, as mentioned previously, pull out the wrap film 8 a certain length to wind around and from the rear of the auxiliary roller 71 to attach on the conveying track 4, and push the accommodating case 7 into the chamber 20 of the base 2 to get positioned, making the invention ready for use.

While the preferred embodiment of the invention has been described above, it will be recognized and understood that various modifications may be made therein and the appended claims are intended to cover all such modifications that may fall within the spirit and scope of the invention.

What is claimed is:

1. An electric dispenser for wrap film comprising:

a base provided with a chamber formed inside of said base, three sidewalls formed around said chamber; said three sidewalls including a front sidewall, a left sidewall and a right sidewall, a plurality of locking grooves formed in said sidewalls and a shaft hole bored in said left sidewall;

two side covers installed on two sides of said base, and one of said side covers being provided with an axial hole;

a conveying track installed in said chamber of said base and provided with at least two axial tubes, two positioning caps inserted in two ends of each said axial tube for locking in said locking grooves of said base, and a driving cap fitted in one end of one of said axial tubes and having female gear teeth set at one end of said driving cap;

a driving device installed at an outside of one of said side covers and provided with a synchronous motor having a driving gear set at one side of said synchronous motor for engaging with said female gear teeth of said driving cap of said conveying track, said synchronous motor be fixed with a control box; and said control box being installed with a switch and a button;

a cutting device stretched across said side covers and provided with a driving motor, a threaded bar, a blade fixing base and an auxiliary rod, said driving motor driven by said driving device to activate said auxiliary rod to rotate, said blade fixing base attached on said auxiliary rod to move along said acial rod auxiliary and provided with a blade fitted at one side of said blade fixing base to extend to a surface of said conveying track; and an accommodating case installed on a top of said base and provided with two sidewalls; each sidewall having a respective locking groove, an auxiliary roller installed at bottom of said accommodating case, a conical pole and a positioning cap inserted in two ends of a spool of a wrap film; and then said wrap film being positioned in said accommodating case, said conical pole fitted with a ring to tightly attach around an interior wall of said spool.

2. The electric power dispenser for wrap film as claimed in claim 1, wherein said sidewalls of said base are bored with plural screw holes, and each of said left sidewall and said right sidewall is provided with a pin hole, an elastic pin hole and a blocking pin hole bored in an upper portion of said right sidewall.

3. The electric power dispenser for wrap film as claimed in claim 1, wherein said base is provided with a blocking strip located on said front sidewall thereof and plural hooking holes bored on said front sidewall.

4. The electric dispenser for wrap film as claimed in claim 1, wherein each of said side covers is provided with plural screw holes, a blade aperture, plural threaded columns corresponding to screw holes bored on said sidewalls of said base.

5. The electric dispenser for wrap film as claimed in claim 1, wherein an inner side of each of said side covers is provided with a pin, a blocking pin, two accommodating grooves and a locking block having a locking slot.

6. The electric dispenser for wrap film as claimed in claim 1, wherein one of said side covers is provided with plural threaded columns.

7. The electric dispenser for wrap film as claimed in claim 6, wherein said control box of said driving device is provided with screw holes for screwing together with said threaded columns of said side cover.

8. The electric dispenser for wrap film as claimed in claim 1, wherein said conveying track is provided with toothed conveying bands laid fully on a surface thereof.

9. The electric dispenser for wrap film as claimed in claim 1, wherein each of said positioning caps is provided with a blocking flange to lean against one end of said axial tube, and an elastic hook set at outside of said blocking flange for locking with said locking groove of said base so as to be positioned thereto.

10. The electric dispenser for wrap film as claimed in claim 1, wherein said driving cap of said conveying track is provided with a blocking flange to lean against the end of said axial tube.

11. The electric dispenser for wrap film as claimed in claim 1, wherein said blade fixing base is provided with guiding strips located at a bottom side of the blade fixing base to be attached to said threaded bar so as to enable said blade fixing base to reciprocate axially along said threads of said threaded bar, and said blade is to be fitted in blade apertures of said side covers.

12. The electric dispenser for wrap film as claimed in claim 1, wherein said cutting device is provided with a cover to contain said driving motor, said threaded bar, said blade fixing base and said auxiliary rod and said cover is provided with a screw at its two ends respectively and a plurality of posts installed at one side of an interior wall thereof for supporting said threaded bar and said auxiliary rod.

* * * * *